US005596814A

United States Patent [19]

Zingle et al.

[11] Patent Number: 5,596,814

[45] Date of Patent: Jan. 28, 1997

[54] VENTED VIAL STOPPER FOR PROCESSING FREEZE-DRIED PRODUCTS

[75] Inventors: Ralph D. Zingle, Philadelphia, Pa.; Nelson A. George, North East, Md.

[73] Assignee: W. L. Gore & Associates, Inc., Newark, Del.

[21] Appl. No.: 554,054

[22] Filed: Nov. 6, 1995

[51] Int. Cl.[6] ..... F26B 25/00

[52] U.S. Cl. ..... 34/296; 34/242; 220/404

[58] Field of Search ..... 34/92, 242, 284, 34/287, 296, 297

[56] References Cited

U.S. PATENT DOCUMENTS

| | | | |
|---|---|---|---|
| 3,454,178 | 7/1969 | Bender et al. | 215/37 |
| 3,953,566 | 4/1976 | Gore | 264/288 |
| 3,962,153 | 6/1976 | Gore | 260/2.5 R |
| 4,096,227 | 6/1978 | Gore | 264/210 R |
| 4,187,390 | 2/1980 | Gore | 174/102 R |
| 4,878,597 | 11/1989 | Haast | 220/404 |
| 5,164,139 | 11/1992 | Fujioka et al. | 264/86 |
| 5,309,649 | 5/1994 | Bergmann et al. . | |

FOREIGN PATENT DOCUMENTS

| | | |
|---|---|---|
| 0343596 | 11/1989 | European Pat. Off. . |
| WO96/06018 | 2/1996 | WIPO . |

OTHER PUBLICATIONS

J. M. Barbaree, A. Sanchez, and G. N. Sanden, "Problems in Freeze–drying: II. Cross–Contamination During Lyophilization," vol. 26 of Developments in Industrial Microbiology, A Publication of the Society of Indusrial Microbiology, 1985, Chapter 27, pp. 407–409.

*Primary Examiner*—Henry A. Bennett
*Assistant Examiner*—Dinnatia Doster
*Attorney, Agent, or Firm*—Gary A. Samuels, Esquire

[57] ABSTRACT

An vented vial stopper for use in processing freeze-dried products is provided. The stopper includes a vent passageway that is covered with a waterproof and moisture vapor permeable membrane to allow the venting of moisture during the freeze-drying process. The membrane also extends to cover most or all of the exposed surface of the stopper to protect the stopper from chemical attack during processing.

4 Claims, 5 Drawing Sheets

VENTED VIAL STOPPER FOR PROCESSING FREEZE-DRIED PRODUCTS

BACKGROUND OF THE INVENTION

1. Field of the Invention

The present invention relates to an apparatus for freeze-drying various products.

2. Description of Related Art

To work effectively in demanding environments (e.g., in the preparation of medicines that must be carefully handled under sterile conditions), apparatus protecting a product to be freeze dried must allow moisture vapor to escape while protecting against contamination of the product during the processing. Additionally, the apparatus should be fully sealable and capable of withstanding the rigors of the freeze-drying environment (e.g., chemical and temperature compatibility, etc.). Finally, all product contact surfaces of the apparatus should be appropriate and compatible for this intended use, such as, biocompatible for contact with pharmaceuticals as well as inert to prevent drug interaction.

Many freeze-drying processes involve placing open containers of material in a freeze-dryer. Containers are kept open until the freeze-drying process is completed, allowing a path for water vapor to be removed from the product. This practice, however, presents a risk of contamination that requires cleanliness and sterility of the freeze-drying equipment and the area surrounding it.

Cross contamination between different batches of product being dried at the same time is also a problem. Cross contamination has been shown to occur in 20 to 80% of vials in a freeze-dryer as reported by Barbaree and Sanchez, 26 *Developments in Industrial Microbiology,* Chapter 27 (1985). Freeze-drying equipment is expensive, and freeze-drying cycles are generally very long, consuming many hours or even several days for the processing of a single batch of material. As a result, freeze-drying manufacturers would prefer to maximize the use of their capital investment in the equipment by attempting to fully load the freeze-drying chamber every time it is cycled. This would result in the practice of freeze-drying different materials in the same chamber at the same time. Since all the materials are in open containers, cross contamination of product would occur. Because of the cross contamination and incompatibility of certain products, freeze-driers are thereby run only partially full, which increases costs.

One example of how to reduce the contamination risk is described in U.S. Pat. No. 3,454,178 to Bender, et al. In that patent, a device is disclosed comprising a vial and a slotted vial cap. When the vial cap is in an "up" position, it allows a path for water vapor to escape the vial. Vials are introduced into the process with their caps in the "up" position, and remain that way until the drying cycle is complete. At the end of the cycle, freeze-drier shelves squeeze down on the vials and press the caps into the "down" position, thus sealing the vials before the drier door is opened. This approach assures that contents of the vials are not contaminated after the process is complete. It also assures that water vapor cannot enter the vials and rehydrate the product once the drier doors are open; indeed, the vials are often repressurized at the end of the process with a dry inert gas, such as nitrogen, prior to pushing the vial caps into the "down" position, to maximize the shelf life of the freeze-dried product. Unfortunately, the problem of contamination of the vial contents when the vials are being loaded into the drier or during the freeze-dry process itself is not addressed by this patent.

In European Patent Application No. 343,596 to Bergmann, et al., a container is described to protect freeze-dried products from contamination during the freeze-drying process. The container has at least one side that includes a hydrophobic, porous, germ-tight, water vapor-permeable membrane. Water vapor can escape the closed container through this porous membrane, while the membrane represents a barrier to contamination. Another technique used involves freeze-drying material in a container that has a porous hydrophobic wall. An example of this approach is taught in U.S. Pat. No. 5,309,649 to Bergmann. Neither of these approaches, however, addresses the concern about rehydrating the contents of the container once the doors of the drier are opened. It is not clear how products freeze-dried in such a container could be kept dry and finally packaged in a vapor-tight container without first exposing the dried product to humidity. Thus, a need exists for a container for freeze-dried products that maintains a well-defined level of protection throughout the entire drying process, as well as providing means for forming a vapor-tight seal on the container before the dryer doors are open.

It has been suggested to use an open-cell foamed hydrophobic porous membrane for drying pasty high viscous compositions in U.S. Pat. No. 5,164,139 to Fujioka et al. This patent suggests using a polytetrafluoroethylene (PTFE) membrane as a product wrap in such an application. While this approach may work under the described conditions, freeze-drying in this manner is not particularly suitable for many freeze-drying processes where the material is left in a container or must be transferred to another container without contamination after the freeze-drying process.

Another approach is described in co-pending U.S. patent application Ser. No. 08/292,992 filed Aug. 19, 1994, by C. Bradford Jones. In that application, a vented vial is provided that utilizes a stopper employing a vent made from permeable PTFE membrane. The porous venting media provides a barrier to bacteria and particulate contamination while permitting the passage of gases, such as air and water vapor. The product described in the copending patent application provides inherent improvements over existing technology insofar as chemical inertness of the stopper material. Regretfully, for some applications the stopper may not adequately combine barrier properties with sufficient chemical compatibility and other desirable properties, such as lubricity, sealing, and venting.

SUMMARY OF THE INVENTION

The present invention comprises a conformal coating of expanded polytetrafluoroethylene (ePTFE) membrane applied to the surface of a resilient stopper to create a protective gasketing sheath. This sheath provides many benefits, including: (1) lubricity such that the stopper can easily be inserted into the vial; (2) chemical protection to the resilient stopper from aggressive pharmaceuticals, which, in turn, protects the pharmaceuticals from contamination; (3) sealability or gasketability which ensures hermetic seal once inserted into the vial despite its surface texture and vial diameter variability. The effect of the present invention is that the ePTFE remains porous and permits venting of gases without letting liquids permeate through the membrane to attack the resilient material (such as butyl rubber) underneath. By placing a hole in the resilient stopper and then fusing a membrane over that opening, a sterile barrier is created that facilitates complete venting from the freeze-drying container. This avoids the need for a mounting fixture for the membrane which is then attached to the stopper via some chemical or mechanical means.

An improved embodiment of the present invention comprises a second smaller stopper combined with the first stopper described above to function as a final hermetic seal for the vial. This stopper is placed inside the larger stopper and is seated at the end of the freeze-dry process to assure a complete seal to the container.

DESCRIPTION OF THE DRAWINGS

The operation of the present invention should become apparent from the following description when considered in conjunction with the accompanying drawings, in which.

DETAILED DESCRIPTION OF THE INVENTION

The present invention comprises a resilient stopper with a conformal expanded polytetrafluoroethylene (ePTFE) membrane coating. The ePTFE membrane coating is applied to the stopper and secured by use of a heated forming die, under pressure, which thermally fuses the two materials together. The fuse points of the stopper are any of its smooth, outward projecting surfaces. Once the membrane and stopper are completely fused together, the normally opaque membrane turns translucent to transparent. This method can be used for virtually any shape of rubber material as well as with other materials as described below. Preferably the stopper is made of butyl rubber and is also coated with a very light film of silicone oil. This oil, which is normally applied to most stoppers to help the stopper fit into the vial, will cross-link under heat and pressure creating an additional adhesive bond between the stopper and the membrane.

Figure 1:
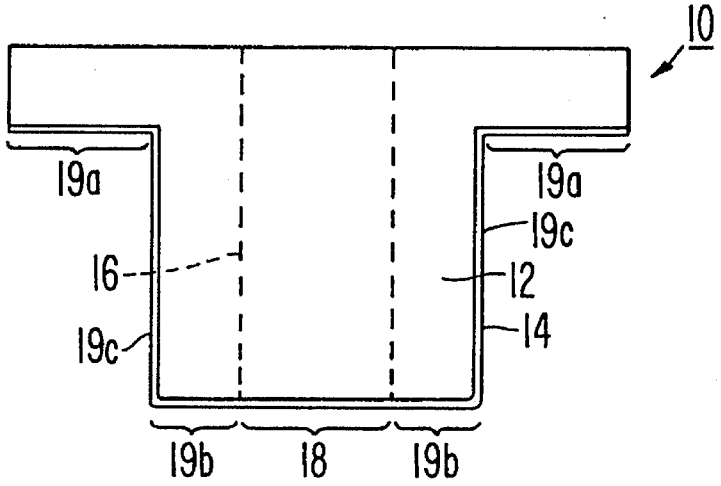
FIG. 1 is a side elevation view of a first embodiment of a freeze-dry stopper of the present invention, including a vent passageway in phantom therethrough.

As is shown in FIG. 1, the stopper 10 of the present invention comprises a resilient stopper core 12 and an expanded PTFE membrane 14 coating most or all of the surface of the stopper that may come in contact with chemicals within a freeze-dry vial during freeze-dry processing. The stopper 10 of the present invention should include some means for venting of water vapor during the freeze-dry process without allowing solids or liquids to escape. One such means comprises providing one or more passageways 16 through the stopper, such as the one passageway 16 down the middle of the stopper 10 as shown. In the construction shown, the expanded PTFE membrane 14 covers one opening 18 to the passageway 16 to provide the necessary selectively permeable barrier. As so constructed, gases can enter and leave a container protected by the stopper of the present invention, while contaminants are excluded from the container.

The construction of the stopper 10 of the present invention provides it with important unique properties. In the area of opening 18, the membrane comprises a porous material that provides selective air flow therethrough. However, elsewhere on the stopper core 12, the membrane 14 serves to protect the core 12 material from exposure to the interior of a freeze-drying vessel and vapors or material therein that may react with or degrade the stopper core. Not only does this protect the core material from attack, it also protects the contents of the vessel from contact with or outgassing from the core. Preferably, the membrane is densifted on at least some of the covered surface of the core.

A particularly preferred embodiment of the basic stopper 10 of the present invention employs a membrane 14 that is selectively densified. Specifically, it is desirable that bottom-facing surfaces **19*a*, 19*b* are densified more thoroughly than side-facing surface 19*c*. In this manner, side-facing surface 19*c* supplies some degree of conformability when the stopper 10** is placed in a vessel, thus creating an easier and better seal within the vessel.

Figure 2:
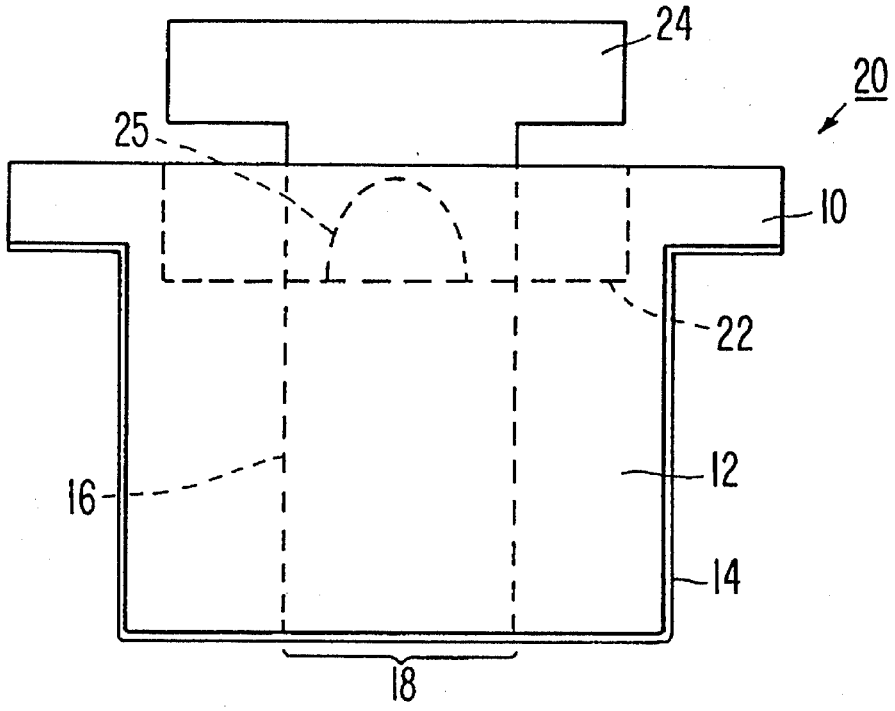
FIG. 2 is a side elevation view of a second embodiment of a stopper of the present invention, including a smaller stopper mounted on top, in up position, to allow for hermetic sealing at the end of the freeze-dry process, and seat for the smaller stopper and a vent passageway in phantom therethrough.

As is shown in FIG. 2, a second embodiment of the present invention can be provided with a multiple component stopper assembly 20. The stopper assembly 20 includes a base stopper 10, again with a vent passageway 16, an outer protective coating 14, and a selectively sealed opening 18 as well as a seat or cavity 22 on top such that another, smaller, freeze-dry stopper 24 (or "plug") can be placed inside. The smaller stopper 24 includes one or more vent openings 25 therein to allow vapor to escape through the stopper assembly when the smaller stopper 24 is in an "up" position.

The small stopper 24 is placed in the "up" position shown during the freeze-dry process to allow the water vapor passing out of the vial to escape through the membrane 14. Once the freeze-dry process is complete, the passageway 16 is sealed by inserting the smaller stopper 24 into cavity 22, so that the freeze-dry container is sealed. In this case, the smaller stopper 24 is adapted to be collapsed within the larger stopper 10 following freeze-drying so that a hermetic seal is created. This seal is important so that water vapor does not seep back into the vial causing premature hydration of the freeze-dried product. This smaller stopper 24 should have a hard Durometer (for instance, >60) to facilitate a hermetic seal.

The insertion of the smaller stopper 24 into the larger stopper 10 may be accomplished through a variety of means. Each of the smaller stoppers 24 can be individually inserted after the freeze-dry process, either manually or through mechanized means. Preferably, the smaller stoppers are automatically sealed as a group, such as collapsing a shelf upon an entire tray of containers.

Figure 3:
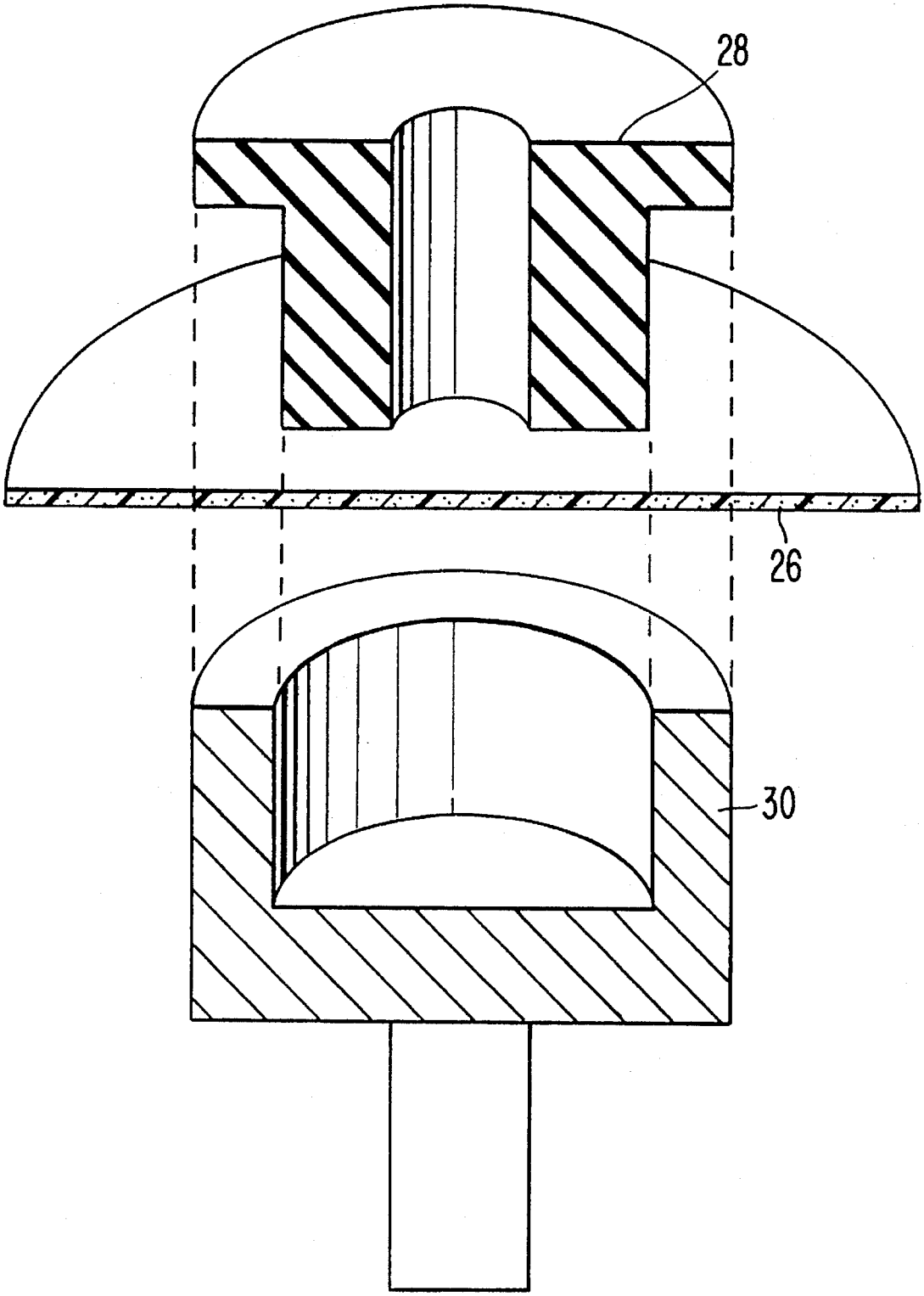
FIG. 3 is a side cross-section view in exploded orientation of a butyl rubber stopper, expanded PTFE membrane, and a forming die used to form the stopper of the present invention.

A preferred method of constructing the stopper of the present invention is shown in FIG. 3. First, a circular membrane patch 26 of ePTFE membrane is placed on the bottom of the stopper core 28 such that their centers are aligned. Next, a heated forming die 30 is used to conform the membrane 26 to the stopper core 28. Pressure is applied to fuse the membrane to the rubber core. Typical sealing conditions are a temperature of 220° to 350° C., a pressure of 30 to 80 psi, over a period of time of 1 to 10 seconds.

Preferably, the forming die 30 is made slightly larger in diameter than the stopper core 28 so that the membrane on the sides is not compressed. In this manner, as has been described, some of the conformable properties of the ePTFE are preserved-allowing for it to provide gasketing between the stopper and the vial. Since PTFE has a very low coefficient of friction, it allows the stopper to be easily inserted into a freeze-dry container, such as a glass vial, without addition of a lubricant, such as silicone oil, and forms a hermetic seal despite variations in the container. The assembly of the stopper within a vial is shown in FIG. 4.

Constructed in this manner, the ePTFE membrane will densify in those areas where full heat and pressure is applied by the forming die 30, forming a translucent or transparent PTFE layer. However, the ePTFE remains fully porous and conformable in other areas. This allows for proper gasketing, and, of course, for the controlled passage of gases through the passageway in the stopper.

Figure 4:
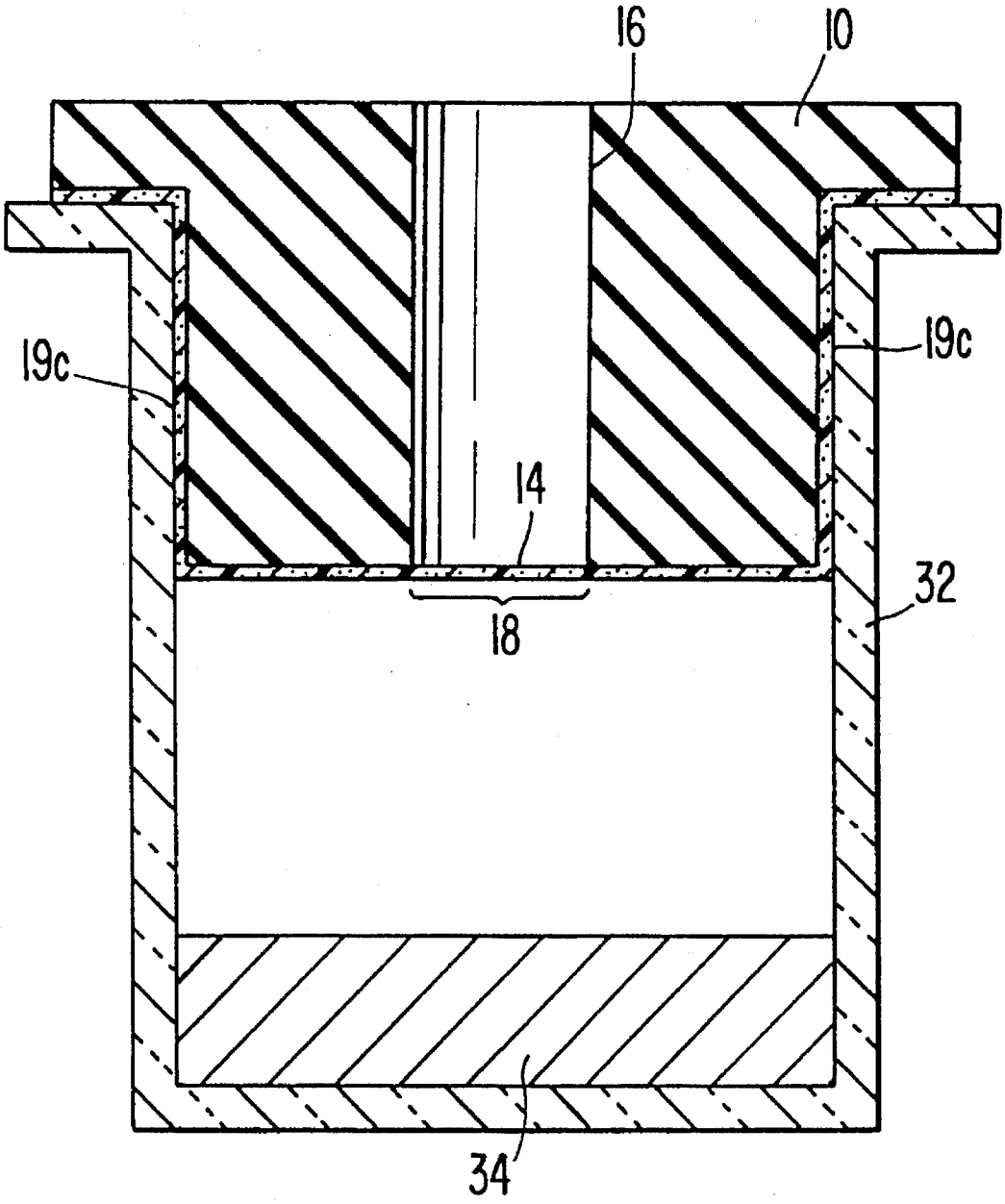
FIG. 4 is a cross-section view of a stopper of the first embodiment of the present invention shown placed in a freeze-dry vial.

As is illustrated in FIG. 4, the basic stopper 10 configuration of the present invention fits into a typical freeze-dry vessel 32 in the manner shown Side-facing surface 19*c*, which has conformable membrane 14 attached to it, forms a tight seal against the inside of the vessel 32. In operation, material to be freeze-dried 34 is placed within the vessel 32 and then the vessel 32 is capped with stopper 10. During the freeze-drying process, moisture passes out of passageway 16, through the membrane 14 portion covering opening 18.

Securing the stopper 10 of the present invention to a vessel 32 establishes a bacterial barrier between the contents of the vessel and the surrounding environment. This minimizes contamination risks and may allow transport of the vessels in other than expensive aseptic environments.

It should be appreciated that the stopper of the present invention retains all the advantages of previous stoppers that merely employ an ePTFE membrane as a barrier layer. Moreover, the stopper of the present invention allows use of desirable resilient material like butyl rubber, without risk of chemical breakdown or incompatibility, sticking or fitting problems, or other deficiencies that exposed rubber material might experience in these applications.

Preferably the rubber stopper is also coated with a lubricant such as a very light film of silicone oil. A lubricant such as silicone oil, which is normally applied to most stoppers to help the stopper fit into the vial, will cross-link under heat and pressure creating an additional adhesive bond between the stopper and the membrane.

Figure 5:
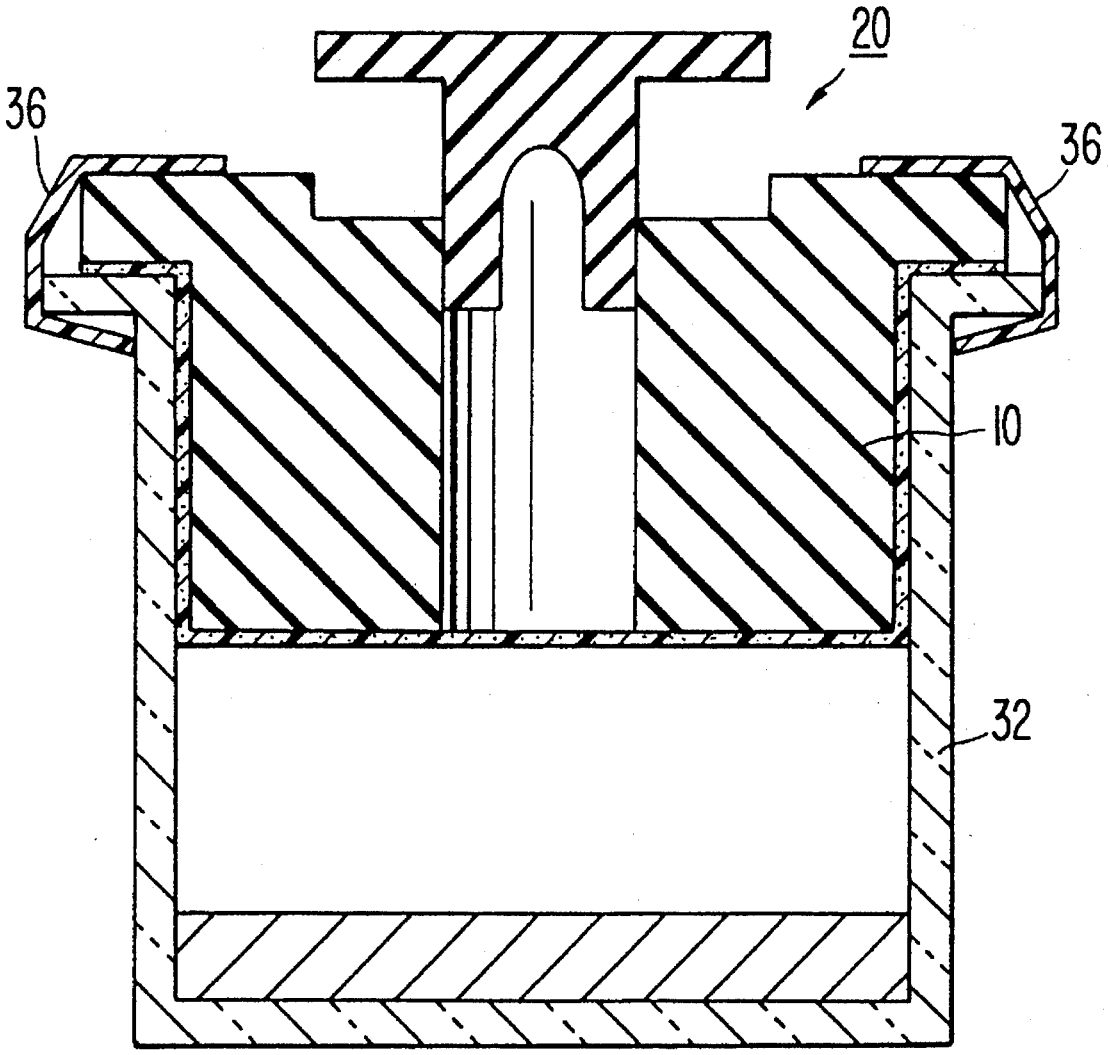
FIG. 5 is a cross-section view of a stopper of the second embodiment of the present invention placed in a freeze-dry vial in use with a locking cap applied.

A further improvement of the present invention is provided in the embodiment illustrated in FIG. 5. In this embodiment, a locking clip 36, such as one made from plastic or metal, is provided to hold the stopper 10 in a seated position in a vial 32 or other vessel during handling. The locking clip or overcap 36 prevents the stopper 10 from unseating itself during transport from the freeze-drier to the capping, inspection, or packing processes within the pharmaceutical manufacturing system. Although an unclipped stopper 10 will unseat itself in only a very small percentage of vials, the risk of such an event causes some manufacturers to use larger areas of aseptic environments to avoid any risk of product contamination. Ideally, this stopper 10 comprises the multiple component stopper assembly 20 previously described.

Figure 6:
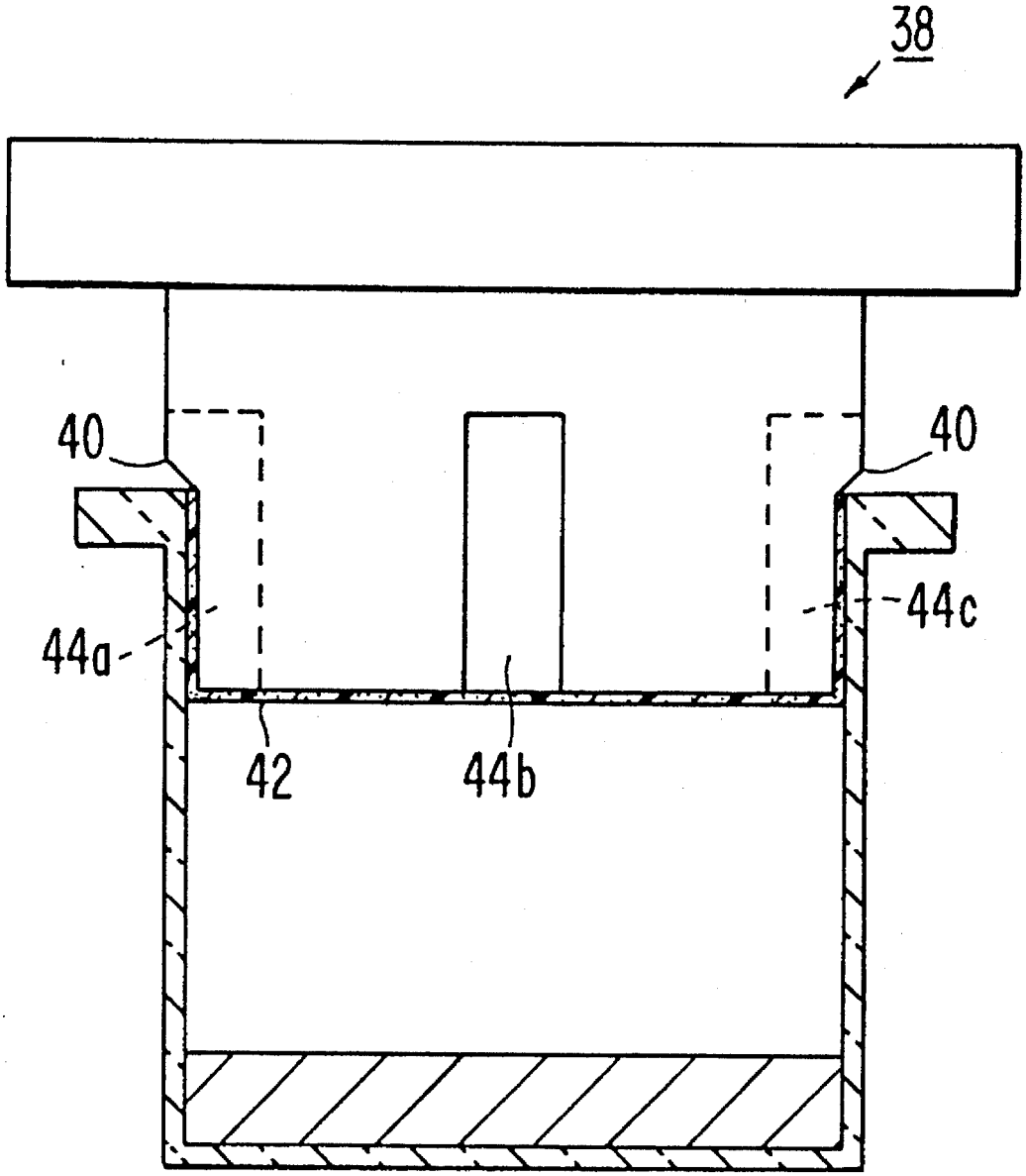
FIG. 6 is a cross-section view of still another embodiment of a stopper of the present invention.

Still another embodiment of the present invention is shown in FIG. 6. This embodiment comprises a one-piece stopper 38. In an "up" position, water vapor is allowed to release during freeze-drying. The stopper is provided with steps 40 on its sides to allow the stopper to sit in the "up" position. Membrane 42 gaskets to the glass vial affecting a seal, and thusly providing a sterile barrier. The step 40 in the stopper is such that after freeze-drying is complete, the stopper is forced "down" completing the hermetic seal for storage. The stopper has multiple channels 44*a*, 44*b*, 44*c* (could have 1 or many more) to permit vapor escape thru the membrane in the "up" position but when pressed "down," the channels are below the glass/stopper seal area and do not permit vapor permeation.

It is preferred to use a membrane of expanded PTFE in the present invention as the stopper cover, such as that made in accordance with U.S. Pat. Nos. 3,953,566, 3,962,153, 4,096, 227, and 4,187,390, all incorporated by reference. Most preferably, the membrane used in the present invention comprises one with a minimum porosity of 50%, and a preferred porosity of 70–90%, and an air permeability of <100 Gurley seconds, and a preferred permeability of 2–30 Gurley sec.

The ePTFE membrane layer could also be comprised singularly or in combination of the following materials: polyamide, polycarbonate, polyethylene, polypropylene, polysulfone, polyvinyl chloride, polyvinylidene fluoride, acrylate copolymer, methacrylate copolymer, Tyvek® spunbonded olefin, and the like.

Test Procedure

Gurley Number

The resistance of samples to air flow was measured by a Gurley densometer (ASTM D726-58) manufactured by W. & L. E. Gurley & Sons. The results are reported in terms of Gurley number which is the time in seconds for 100 cubic centimeters of air to pass through 1 square inch of a test sample at a pressure drop of 4.88 inches of water.

"Bubble point" is the pressure of air required to blow the first continuous bubbles detectable by their rise through a layer of isopropyl alcohol covering the PTFE media. The bubble point of the porous PTFE is measured using isopropyl alcohol following ASTM Test Method F316-86.

"Porosity" was determined by using the following equation:

$$\text{Porosity} = \left( \frac{P_{PTFE\ Bulk} - P_{PTFE\ Membrane}}{P_{PTFE\ Bulk}} \right) \times 100$$

Where P=density. Density was determined by standard mass and volume measurements on a 5 inch×5 inch (127 mm×127 mm) sample. The accepted value for the standard density of solid bulk PTFE is 2.2 g/cc. Porosity is therefore the percentage void volume of PTFE membranes.

Without intending to limit the scope of the present invention, the following examples illustrate how the present invention may be made and used:

EXAMPLE 1

Multiple 20 mm rubber stoppers P/N 1014-5820, available from The West Company of Lionville, Pa., were obtained and an aluminum heating die was machined to conform to the entire bottom side of the stoppers. The die was machined such that when the stopper was placed within the die, all rubber surfaces would be in contact with aluminum. The aluminum heating die was then affixed to an impact heat seal machine which can heat the die to specified temperatures while imparting a vertical load from a 1 inch (25.4 mm) diameter pneumatic cylinder for a specified period of time. GORE-TEX® expanded PTFE membrane, PIN X18433 available from W. L. Gore & Associates, Inc. of Elkton, Md., was then cut into a 1"×1" square (25.4×25.4 mm). The stopper was then placed bottom side up directly below the impact seal machine with aluminum die. The square of the membrane was then laid over the bottom of the stopper. The die was heated to a temperature of 330° C. and then pressed down over the stopper so as to conform the sample of membrane to all surfaces using the impact heat sealer using air pressure of 40 psi for a period of 6 seconds. The die was then raised and removed. The stopper, with membrane attached, was allowed to cool for about 30 seconds.

The stopper was then removed from the apparatus and observed for conformity, continuity, and durability of the membrane layer. The membrane could not be pulled, scratched or easily removed from the surface of the stopper yet remained pliable. Using a pair of tweezers, the membrane was pulled from the stopper with much effort leaving bits and layers of membrane indicating that the bond of the rubber to membrane was greater than the cohesive strength of the membrane.

A membrane coated stopper was than inserted within a 20 mm glass vial available from The West Company, of Lionville, Pa., PIN 6800-0318. The stopper fit snugly but was very easy to slide within the glass vial precluding the need for added lubricant.

EXAMPLE 2

A stopper was prepared as in Example 1 above but before sealing the membrane, a hole about 0.29 inches (7.37 mm) in diameter was drilled along the center axis from the top surface to the bottom surface of the stopper to produce a passageway therethrough. A membrane was affixed to it as in Example 1. A 13 mm stopper, P/N 13-70, available from Tompkins Rubber Company of Blue Bell, Pa., was then inserted into the top of the 20 mm stopper to function as a controllable secondary seal. The 13 mm stopper was a freeze-dry stopper that had an increased hardness of 70 Durometer to facilitate a good seal with the 20 mm rubber stopper. In the "up" position, the 13 mm freeze-dry stopper permits the flow of water vapor out of the vial during freeze-drying and, when pressed down into the 20 mm stopper during final processing, forms a hermetic seal.

EXAMPLE 3

A stopper was prepared as in Example 2 but a recess about 0.5 inches (12.7 mm) in diameter was cut along the center axis from the top surface towards the bottom to a depth of 0.09 inches (2.28 mm). A membrane was affixed as in Example 1. A 13 mm stopper was inserted as in Example 2, however, since the 20 mm stopper has a recess cut on top, the 13 mm stopper did not stick up above the top of the 20 mm stopper when pressed down into the 20 mm stopper during final processing to form a hermetic seal. This allowed an overcap to be applied to secure the stopper assembly to the vial.

EXAMPLE 4

Component parts were prepared as in Example 3, however, a special overcap was formed from aluminum such that it sealed the 20 mm stopper to the vial. This prevented spontaneous leaking while permitting the insertion of the 13 mm stopper for freeze-drying. Once the freeze-dry process was completed, the 13 mm stopper was driven into the 20 mm stopper to form a hermetic seal which could be further secured and overcapped.

EXAMPLE 5

The system components were formed as in Example 4, however, the overcap was fashioned such that first the 13 mm stopper was assembled into the 20 mm stopper in a vial then the overcap was applied to seal the system to the vial. Overall, the 13 mm stopper can be positioned into an "up" position to allow water vapor to escape for freeze-drying. At the end of the process, the overcap is collapsed driving the 13 mm stopper into the 20 mm stopper and sealing the entire system with the collapsed overcap.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A device for sealing and venting a freeze-drying container that comprises a sealable core adapted to seal an opening in the container, the core having at least one passageway therethrough;

a membrane of expanded polytetrafluoroethylene, the membrane being resistant to liquid penetration and permeable to moisture vapor, the membrane being adhered to the core so as to serve both as a barrier to liquids passing through the passageway and as a protective covering to the core;

wherein moisture vapor within the container vents through the membrane and the passageway to outside the container during the freeze-drying process; and wherein the membrane protects resilient core against chemical attack and adhesion to the container.

2. The device of claim 1 that further includes a means to hermetically seal the passageway through the resilient core.

3. The device of claim 2 wherein the means to seal the passageway comprises a stopper slidably positioned within the passageway.

4. The device of claim 1 wherein the membrane is densifted along portions of where it is adhered to the core and the membrane remains porous and conformable at least where the membrane covers the opening to the passageway.

* * * * *